US009277617B2

(12) United States Patent
Schou et al.

(10) Patent No.: US 9,277,617 B2
(45) Date of Patent: Mar. 1, 2016

(54) DEVICE FOR CONTROLLING LIGHT-EMITTING DIODES WITH VERY HIGH LUMINANCE RANGE FOR VIEWING SCREEN

(75) Inventors: Guy Schou, Le Bouscat (FR); Frédéric Renaud, Mios (FR)

(73) Assignee: Thales, Neuilly sur Seine (FR)

( * ) Notice: Subject to any disclaimer, the term of this patent is extended or adjusted under 35 U.S.C. 154(b) by 218 days.

(21) Appl. No.: 13/487,108

(22) Filed: Jun. 1, 2012

(65) Prior Publication Data

US 2012/0306946 A1 Dec. 6, 2012

(30) Foreign Application Priority Data

Jun. 1, 2011 (FR) ..... 11 01681

(51) Int. Cl.

| | |
|---|---|
| ***G09G 3/36*** | (2006.01) |
| ***G09G 5/10*** | (2006.01) |
| ***H05B 37/02*** | (2006.01) |
| ***H05B 33/08*** | (2006.01) |

(52) U.S. Cl.

CPC ..... *H05B 33/0845* (2013.01); *H05B 33/0818* (2013.01)

(58) Field of Classification Search

CPC ..... H05B 33/0818; H05B 33/0845
USPC ..... 345/82, 102, 204, 690, 691
See application file for complete search history.

(56) References Cited

U.S. PATENT DOCUMENTS

| | | | |
|---|---|---|---|
| 5,270,818 | A | 12/1993 | Ottenstein |
| 5,615,093 | A | 3/1997 | Nalbant |
| 5,640,313 | A | 6/1997 | Takehara et al. |
| 5,724,062 | A | 3/1998 | Hunter |
| 5,786,801 | A | 7/1998 | Ichise |
| 5,939,830 | A | 8/1999 | Praiswater |
| 6,114,814 | A | 9/2000 | Shannon et al. |
| 6,305,818 | B1 | 10/2001 | Lebens et al. |
| 6,344,641 | B1 | 2/2002 | Blalock et al. |

(Continued)

FOREIGN PATENT DOCUMENTS

| | | | |
|---|---|---|---|
| EP | 0 313 331 | A2 | 4/1989 |
| JP | 59 195627 | A | 3/1985 |

OTHER PUBLICATIONS

French Search Report for Counterpart French Application No. 1101681, 6 pgs. (Dec. 27, 2011).

(Continued)

*Primary Examiner* — Amare Mengistu
*Assistant Examiner* — Jennifer Zubajlo
(74) *Attorney, Agent, or Firm* — Blakely, Sokoloff, Taylor & Zafman LLP

(57) ABSTRACT

The general field of the invention is that of devices for controlling luminance of lighting devices comprising light-emitting diodes. The control device is driven by a cyclic input signal of determined period, each period comprising an activation time representative of a determined luminance level. The control device comprises analog electronic means generating a second control signal for the intensity of the electric current passing through the light-emitting diodes, the amplitude of the second control signal being an increasing function of the activation time in such a way that the combination of the cyclic input signal and of the second signal applied to the light-emitting diodes gives a greater luminance range than the range of the cyclic input signal.

6 Claims, 5 Drawing Sheets

(56) References Cited

U.S. PATENT DOCUMENTS

| | | | | |
|---|---|---|---|---|
| 6,469,454 | B1 | 10/2002 | Mader et al. | |
| 6,659,622 | B2 | 12/2003 | Katogi et al. | |
| 6,674,060 | B2 | 1/2004 | Antila | |
| 6,888,529 | B2 | 5/2005 | Bruning et al. | |
| 7,148,632 | B2 | 12/2006 | Berman et al. | |
| 7,178,941 | B2 | 2/2007 | Roberge et al. | |
| 7,365,500 | B2 | 4/2008 | Jang | |
| 7,498,751 | B2 | 3/2009 | Bai et al. | |
| 7,515,128 | B2 * | 4/2009 | Dowling | H05B 37/02 315/291 |
| 7,579,786 | B2 * | 8/2009 | Soos | H05B 33/0803 315/291 |
| 7,804,478 | B2 | 9/2010 | Schou et al. | |
| 7,880,400 | B2 * | 2/2011 | Zhou | H05B 33/0818 315/185 S |
| 7,948,454 | B2 * | 5/2011 | Biwa | H05B 33/0857 257/13 |
| 8,279,138 | B1 * | 10/2012 | Margulis | G03B 21/00 345/1.1 |
| 2002/0070914 | A1 | 6/2002 | Bruning et al. | |
| 2002/0105487 | A1 | 8/2002 | Inoue | |
| 2002/0113192 | A1 | 8/2002 | Antila | |
| 2002/0114155 | A1 | 8/2002 | Katogi et al. | |
| 2002/0122019 | A1 | 9/2002 | Baba et al. | |
| 2004/0051691 | A1 * | 3/2004 | Hedrick | G09G 3/3406 345/102 |
| 2006/0170370 | A1 | 8/2006 | De Anna | |
| 2006/0256049 | A1 * | 11/2006 | Schou | G09G 3/32 345/82 |
| 2009/0079357 | A1 * | 3/2009 | Shteynberg | H05B 33/0818 315/291 |
| 2010/0219764 | A1 | 9/2010 | Yamasaki et al. | |

OTHER PUBLICATIONS

Travis, "Little ICS Generate Long Voltages," XP001074433, EDN Electrical Design News, Reed Business Information, Highlands Ranco. Co., US, vol. 45, No. 13, pp. 73-74, 76, 78, 80 (2000).

* cited by examiner

DEVICE FOR CONTROLLING LIGHT-EMITTING DIODES WITH VERY HIGH LUMINANCE RANGE FOR VIEWING SCREEN

BACKGROUND OF THE INVENTION

1. Field of the Invention

The field of the invention is that of the back-lighting of passive viewing screens also called LCDs for "Liquid Crystal Displays". These screens are light modulators and require an external lighting source in order to operate.

2. Description of the Prior Art

In a certain number of applications, in particular in the aeronautical field, these screens are used by day and at night. Consequently, the lighting source must possess a high luminance range so as to ensure both correct daytime contrast under strong sunshine and a faintly luminous night-time image so as not to hinder the pilot's nocturnal vision. Thus, luminance ranges of the order of 1000 to 10 000 may be specified.

Technically, to achieve these high ranges, use is made of control signals modulated in terms of duty ratio, also called "PWM" for "Pulse Width Modulation". These periodic signals comprise, during each period, a variable activation time. However, the specified luminance range may be greater than the range of the PWM control signal provided. For example, the range of the PWM signal may be limited to 100 whereas the required range is of the order of 1000.

For certain lighting sources, control by duty ratio turns out to be sufficient. Mention will be made notably of fluorescent lamps of "HCFL" ("High Cathode Fluorescent Lamp") or "CCFL" ("Cold Cathode Fluorescent Lamp") type. Indeed, when the activation time is very small, having regard to the technical nature of these sources, the light emitted is not proportional to the activation time but is much smaller than the latter whereas, when the activation time is greater, the light emitted becomes proportional to the activation time. For example, for an activation time corresponding to 1% of the period of the PWM, the quantity of light emitted will be 0.1% of the possible maximum, whereas, for an activation time corresponding to 50% of the period of the PWM, the quantity of light emitted will be close to 50% of the possible maximum. Thus, naturally, the sought-after increased luminance range is obtained.

However, certain lighting sources like light-emitting diodes or LEDs have very low response times. Having regard to their performance in respect of dimensions, luminous efficiency and lifetime, LEDs are increasingly used to achieve lighting sources for display screens. In this case, the previous effect is no longer present. If the light-emitting diodes are solely controlled by the PWM signal, the luminance emitted is directly proportional to the activation time of the PWM, no longer making it possible to obtain the sought-after effect, that is to say a high brightness range.

To alleviate this drawback, the modulation of the luminance of the LEDs is achieved either by modulating the amplitude of the current which passes through them, or by modulating the activation time over a given period by a PWM signal, or by combining the two modulations to obtain a very high depth of modulation. Technically, to carry out this modulation of the amplitude/modulation of the activation time distribution, use is made of an arithmetical and logical calculation function which works on digital signals. FIG. 1 represents a digital control device using this principle. This device 1 comprises a digital controller 2 which receives a luminance setting CL. This controller 2 generates two digital signals.

The first signal is a temporal signal SPWM modulated in terms of duty ratio having a determined activation time, dependent on the luminance setting. The second signal $_{SA\text{-}N}$ is a control signal for the current passing through the array of light-emitting diodes. It is transformed into an analog signal $S_{A\text{-}A}$ by means of a digital-analog converter 3 or "DAC" and then applied to the electronic control circuits 4 for the LED array 5. The device can optionally be supplemented with a slaving device making it possible to finely adjust the luminance emitted by the diodes. It is represented by a dotted arrow in FIG. 1.

However, this technical solution may exhibit certain drawbacks. In the aeronautical context, even if these calculation resources are justified by other needs, the PWM/amplitude distribution calculation function is subject to the most constraining procedures of development and certification of RTCA/DO-254 type, entitled "Design Assurance Guidance For Airborne Electronic Hardware" or RTCA/DO-178 type, entitled "Software Considerations in Airborne Systems and Equipment Certification".

Moreover, on account of problems of obsolescence related to the gradual disappearance of fluorescent lamps, equipment manufacturers are tending to replace back-lighting based on fluorescent lamps with lighting units based on LEDs. Now, as has been seen, fluorescent lamps are controlled by a simple PWM signal. In these cases, the equipment manufacturer or the aircraft manufacturer does not want to introduce modifications of the existing numerical calculation functions so as to avoid any re-certification of the viewing device or to add any, necessarily complex, digital circuit carrying out the PWM/amplitude distribution calculation.

SUMMARY OF THE INVENTION

The device according to the invention makes it possible to alleviate these various drawbacks. Indeed, it comprises analog electronic means making it possible to generate a control signal for the intensity of the electric current passing through the light-emitting diodes and which, combined with control by a conventional PWM signal, makes it possible to achieve high luminance ranges.

More precisely, the subject of the invention is a device for controlling luminance of a lighting device comprising light-emitting diodes, the said control device being driven by a cyclic input signal of determined period, each period comprising an activation time representative of a determined luminance level, the said cyclic input signal controlling the turning on of the light-emitting diodes during the said activation time, the said control device comprising analog electronic means generating a second control signal for the intensity of the electric current passing through the light-emitting diodes, characterized in that the amplitude of the second control signal is an increasing function of the activation time in such a way that the combination of the cyclic input signal and of the second signal applied to the light-emitting diodes gives a greater luminance range than the range of the cyclic input signal.

Advantageously, in a first embodiment, the analog electronic means comprise an integrator circuit, the second signal corresponds to the output signal of the said integrator circuit, the time constant of the said integrator circuit being greater than a predetermined minimum activation time.

Advantageously, in a second embodiment, the analog electronic means comprise an amplitude ramp generating circuit devised in such a way that the amplitude of the second signal is sawtooth-shaped, the period of the sawtooth being that of the cyclic signal.

The invention also relates to a viewing device comprising a display screen with light modulation, a lighting device comprising light-emitting diodes and a device for controlling the said lighting device such as defined hereinabove.

BRIEF DESCRIPTION OF THE DRAWINGS

The invention will be better understood and other advantages will become apparent on reading the nonlimiting description which follows and by virtue of the appended figures among which.

DETAILED DESCRIPTION

Figure 1:
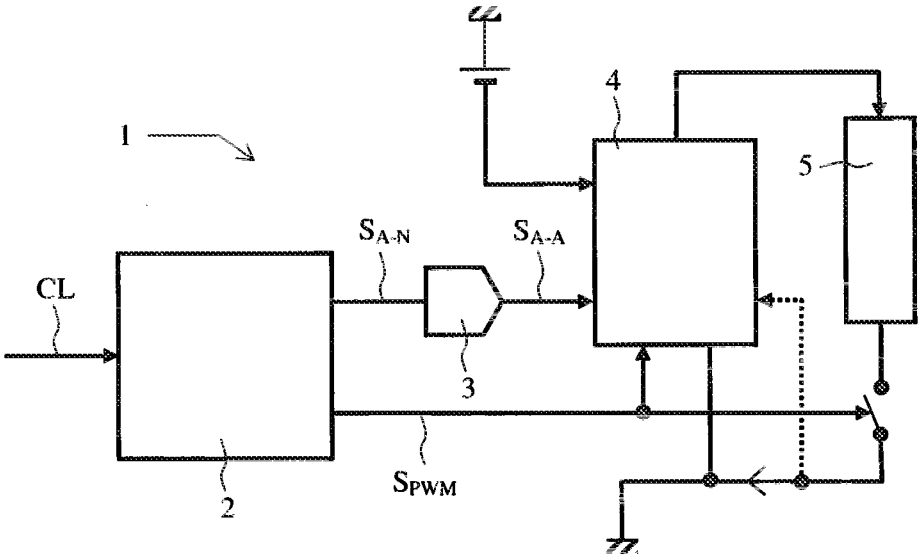
FIG. 1 (PRIOR ART)
FIG. 1 already described represents the schematic of a device for controlling luminance of a lighting device according to the prior art.
Figure 2:
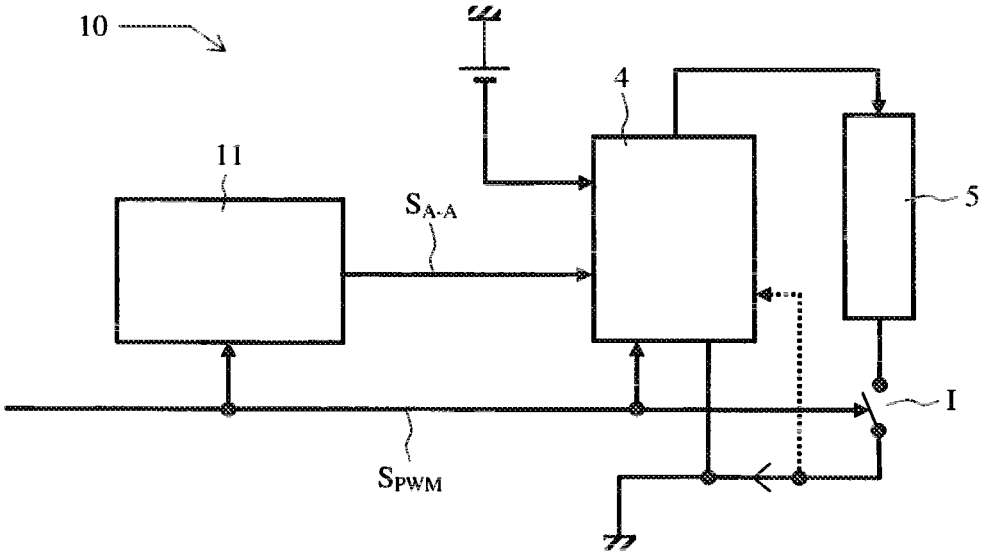
FIG. 2 represents the schematic of a device for controlling luminance of a lighting device according to the invention.

By way of example, FIG. 2 represents the schematic of a control device 11 for controlling the luminance of a lighting device according to the invention. The lighting 5 is a lighting based on light-emitting diodes. The diodes are preferably so-called "white" diodes emitting over the whole of the visible spectrum. But, it is also possible to drive triplets of red, green and blue coloured diodes with a device according to the invention. The diodes are conventionally arranged in series. The means 4 for supplying current to the diodes are conventional and well known to the person skilled in the art.

The control device 11 is driven by a cyclic input signal denoted as previously $S_{PWM}$. This signal has an insufficient range to cover the whole of the luminance range required for the diodes. For example, the range of the PWM signal is from 1 to 100 whereas the luminance range is from 1 to 1000.

The signal $S_{PWM}$ directly controls the turning on of the array of diodes. This control is symbolized by a switch I in FIG. 2. The signal $S_{PWM}$ is also used as input signal for the analog electronic means 11. The function of these means is to produce an analog signal $S_{A\text{-}A}$ which is applied to the electronic control circuits 4 of the LED array 5. It is known that the signal $S_{PWM}$ is a periodic signal, each period of duration T comprising an activation time TA during which this signal has a constant setting value, the signal being zero outside of this activation time TA. The function of the electronic means 11 is to apply to the signal $S_{PWM}$ in the form of a gating pulse an electronic function generating an output signal $S_{A\text{-}A}$ which increases with the duration of the activation time. This signal $S_{A\text{-}A}$ is applied as amplitude setting for the control of the current in the LEDs. This signal therefore creates an additional range which supplements that of the signal $S_{PWM}$. For example, if the range of the initial signal $S_{PWM}$ is from 1 to 100, thus signifying that the activation time can vary in a ratio 100 and if, as a function of the activation time, the amplitude of the signal $S_{A\text{-}A}$ varies from 1 to 10, that is to say this signal equals a certain value for very low activation times and 10 times this value for the maximum activation time, the total luminance range then varies from 1 to 1000, this being the result sought.

There exist various simple means making it possible to embody the electronic means 11. By way of first exemplary embodiment. FIGS. 3, 4, 5, 6 and 7 respectively represent the schematic of the electronic means, the luminance range obtained by virtue of its means and the amplitude variations of the current applied to the diodes for three different activation times.

Figure 3:
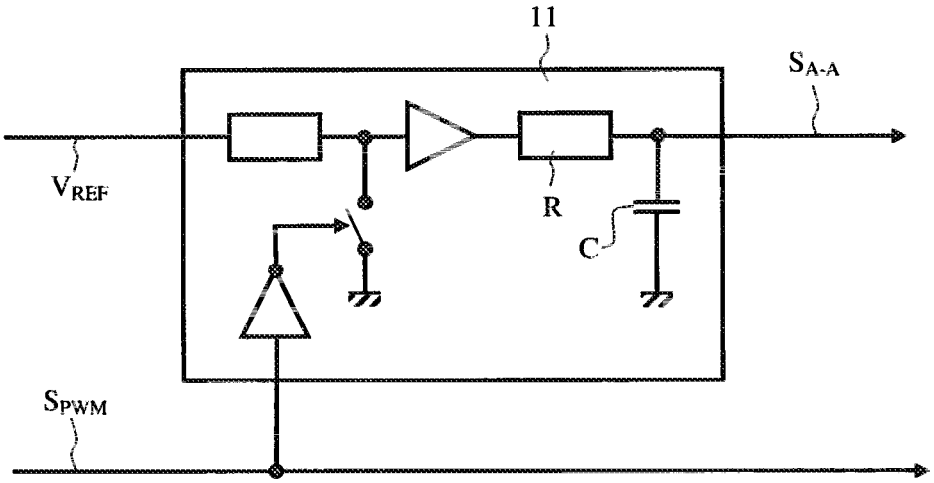
FIG. 3 represents a first embodiment of the control device according to the invention.

The simplest electronic circuit making it possible to carry out this function is an integrator circuit or RC circuit essentially comprising a resistor R and a capacitor C. This circuit is represented in FIG. 3. The intensity variation depends on the time constant of the integrator, that is to say the product RC, the level of the amplitude depends on a reference voltage $V_{REF}$.

Figure 4:
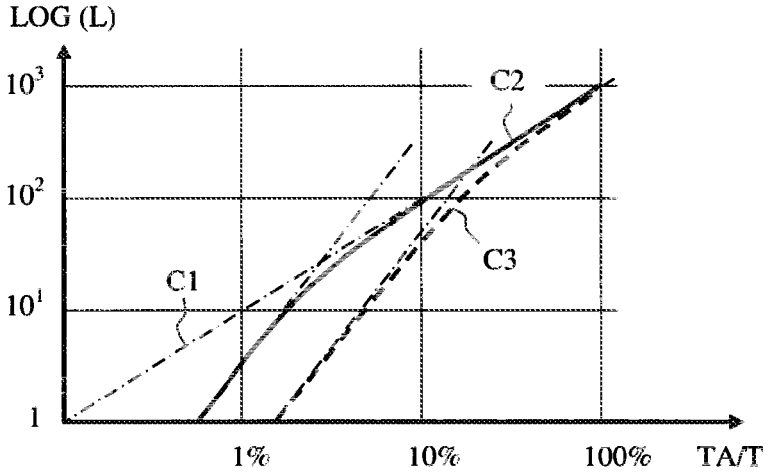
FIG. 4 represents the luminance range obtained with the control device of FIG. 3.

FIG. 4 represents the luminance variation LOG(L) as a function of the percentage of the activation time TA/T of the signal $S_{PWM}$ on a logarithmic scale for two different RC constants. The first curve C1 shown dotted represents the luminance variation if only the signal $S_{PWM}$ is applied. It is a straight line. The luminance range is in this case equal to the range of the signal $S_{PWM}$. The second curve C2 shown as a continuous bold line is representative of a low time constant. In this case, the luminance range is in this case greater than the range of the signal $S_{PWM}$. It is seen that a factor of about 5 is gained. The third curve C3 shown as a bold dashed line is representative of a greater time constant. In this case, the luminance range is in this case markedly greater than the range of the signal $S_{PWM}$. It is seen that a factor of greater than 10 is gained.

Figure 5:
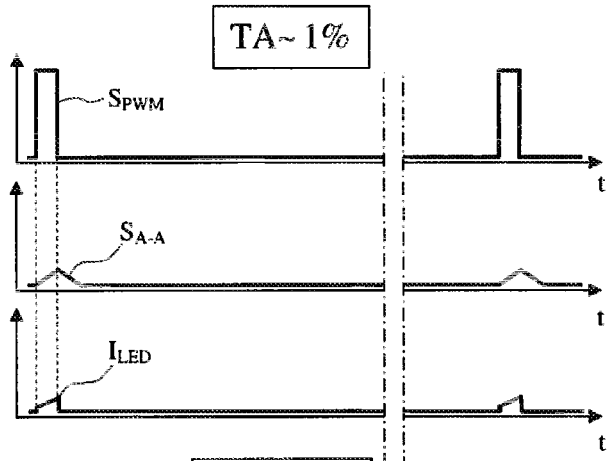
FIGS. 5, 6 and 7 represent, for three different activation times, the amplitude variation of the current applied to the diodes of the lighting device controlled by the device of FIG. 3.
Figure 6:
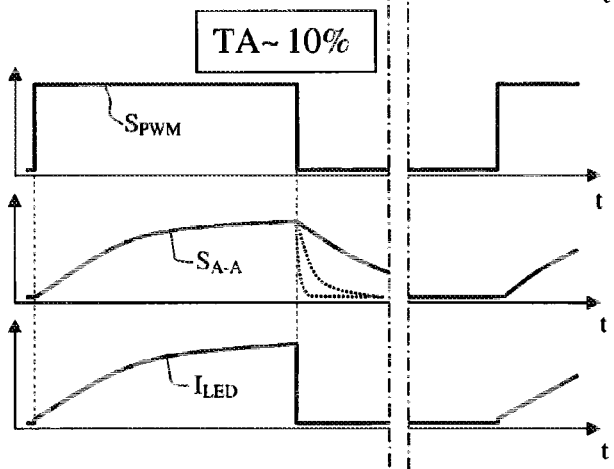
Figure 7:
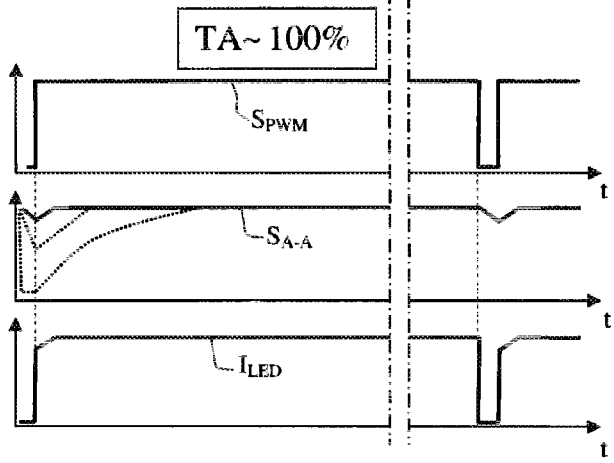

FIGS. 5, 6 and 7 represent the amplitude variations of the current applied to the diodes for three different activation times, FIG. 5 for a very short activation time, typically of the order of 1 percent, FIG. 6 for a mean activation time, typically of the order of 10 percent, FIG. 7 for an activation time similar to the duration of the period of the PWM signal, typically of the order of 100 percent.

Each figure comprises three curves, dependent on the time t for about a period T of the PWM signal. The top curve represents the binary activity of the signal $S_{PWM}$, the intermediate curve the amplitude variation of the signal $S_{A\text{-}A}$ applied to the diodes control circuit, the bottom curve the intensity of the current $I_{LED}$ which actually passes through the diodes and which is modulated both by the signal $S_{PWM}$ and the signal $S_{A\text{-}A}$.

The activation time TA of FIG. 5 is very short and having regard to the time constant of the RC filter, the amplitude of the signal $S_{A\text{-}A}$ does not have time to attain its maximum value.

The activation time TA of FIG. 6 is greater and having regard to the time constant of the RC filter, the amplitude of the signal $S_{A\text{-}A}$ has time to attain its maximum value $S_{MAX}$. However, the mean value of the amplitude of the signal during the time TA remains well below this maximum value $S_{MAX}$.

The activation time TA of FIG. 7 is close to the period of the PWM signal. Having regard to the time constant of the RC filter, the amplitude of the signal $S_{A\text{-}A}$ is practically always at its maximum value $S_{MAX}$ during this time TA. The dotted curves of FIGS. 6 and 7 represent the variations of the signal $S_{A\text{-}A}$ for various values of the RC time constant of the electronic means 11.

By way of second exemplary embodiment, FIGS. 8, 9, 10, 11 and 12 respectively represent the schematic of the electronic means of this second example, the luminance range obtained by virtue of its means and the amplitude variations of the current applied to the diodes for three different activation times.

Figure 8:
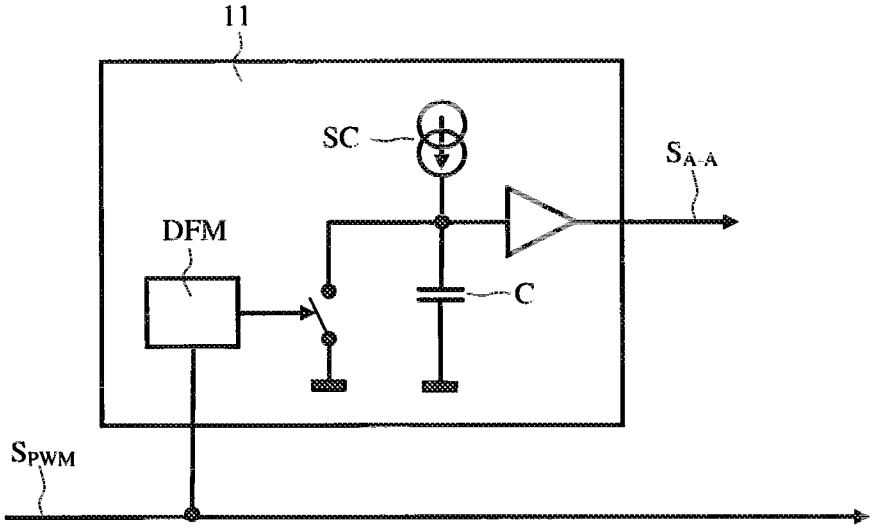
FIG. 8 represents a second embodiment of the control device according to the invention.

The electronic circuit of FIG. 8 makes it possible to create a variation of the signal $S_{A\text{-}A}$ in the form of a temporal ramp. This circuit chiefly comprises a rising edge detector DFM, a current source SC and a capacitor C. The charging of the capacitor at constant current generates an output voltage which increases linearly with time. In theory, this so-called perfect-ramp electronic layout gives a signal $S_{A\text{-}A}$ which varies linearly with the duration TA of the PWM pulse. The amplitude variation of $S_{A\text{-}A}$ as a function of the duration TA can be denoted K·TA. The mean value of the luminance L obtained during the period T of the signal $S_{PWM}$ is therefore proportional to $(TA)^2$.

In a certain number of cases, it is not possible to achieve a ramp extending temporally over the whole of the period of the PWM signal. Typically, the range of the PWM signal can be two to three decades whereas the range of the ramp extends only over a decade. In this case, the amplitude of the signal $S_{A\text{-}A}$ becomes an affine function of the activation time TA only when TA becomes greater than a certain value $TA_0$:

| | | |
|---|---|---|
| We may write: | $TA < TA_0$ | $S_{A\text{-}A} = K1.$ |
| | $TA > TA_0$ | $S_{A\text{-}A} = K1 + K2 \cdot (TA - TA_0)$ |
| and we have: | $TA < TA_0$ | $L \sim K1 \cdot TA$ |
| | $TA > TA_0$ | $L \sim K1 \cdot TA + K2 \cdot (TA - TA_0) \cdot TA$ |

Figure 9:
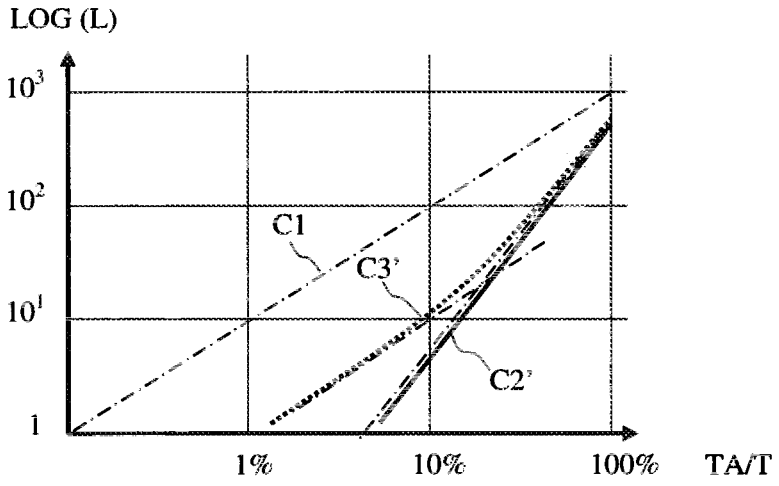
FIG. 9 represents the luminance range obtained with the control device of FIG. 8.

This is what is illustrated in FIG. 9 which represents the luminance variation LOG (L) as a function of the percentage of the activation time TA/T of the signal $S_{PWM}$ on a logarithmic scale in two possible illustrative cases. As in FIG. 4, the first curve C1 shown by thin dashes represents the luminance variation if only the signal $S_{PWM}$ is applied. It is a straight line.

When the duration of the ramp covers almost the entire period T, a second curve C2' represented by the curve shown as a continuous bold line is also obtained. In this case, the luminance range is in this case much greater than the range of the signal $S_{PWM}$.

When the duration of the ramp covers just a part of the entire period T, the third curve C3' shown as a bold dotted line is obtained. In this case, the luminance range L is less than the previous.

Figure 10:
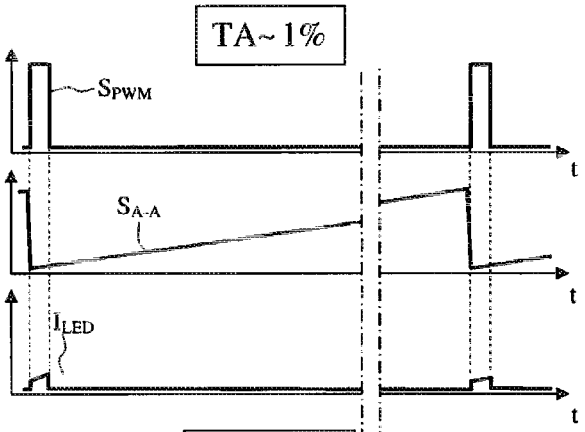
FIGS. 10, 11 and 12 represent, for three different activation times, the amplitude variation of the current applied to the diodes of the lighting device controlled by the device of FIG. 8.
Figure 11:
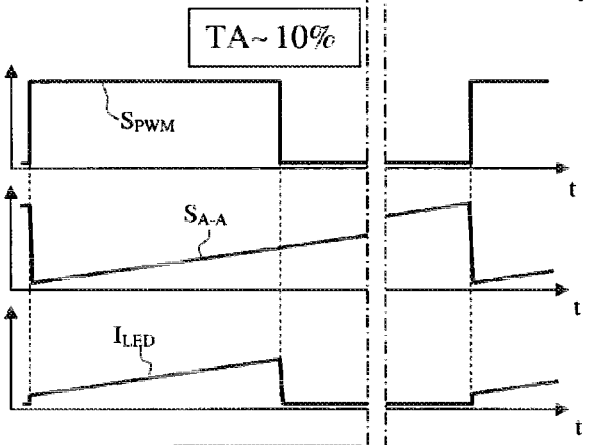
Figure 12:
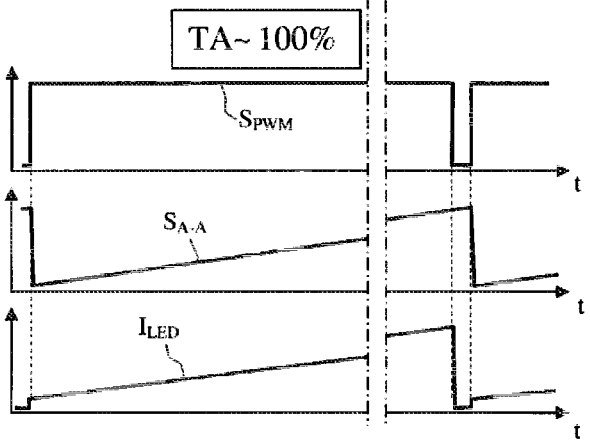

FIGS. 10, 11 and 12 represent the amplitude variations of the current applied to the diodes for three different activation times in the case where the duration of the ramp is similar to the duration of the period of the PWM signal. FIG. 10 represents these variations for a very short activation time, typically of the order of 1 percent, FIG. 11 for a mean activation time, typically of the order of 10 percent, FIG. 12 for an activation time similar to the duration of the period of the PWM signal, typically of the order of 100 percent.

As in the previous example, each figure comprises three curves, dependent on the time t for about a period of the PWM signal. The top curve represents the binary activity of the signal $S_{PWM}$, the intermediate curve the amplitude variation of the signal $S_{A\text{-}A}$ applied to the diodes control circuit, the bottom curve the intensity of the current $I_{LED}$ which actually passes through the diodes and which is modulated both by the signal $S_{PWM}$ and the signal $S_{A\text{-}A}$.

Of course, it is possible to embody numerous possible variants on the basis of these two exemplary embodiments. It is notably possible to alter the durations of return to the minimum level of the setting level of the current in the LEDs when the conduction in the LEDs is interrupted at the end of the activation time TA.

It should be noted that for each of the various possible embodiments, it is always possible to add a slaving device making it possible to adjust the duration of activation so as to obtain exactly the desired luminance.

The advantages of the control device according to the invention are as follows:

- Great ease of implementation through the use of simple electronic functions with the cost savings that this entails;
- Great robustness and great reliability of the electronic means implemented, due to their simplicity;
- Great ease of adaptation to the desired luminance range simply by changing basic electronic components like resistors or capacitors;
- Use of analog technologies which avoids, on the one hand, the use of complex digital components required in order to do the luminance calculations like FPGAs and, on the other hand, the costs of development and of certification of the associated software;
- Great ease of replacement of fluorescent light sources with lighting based on diodes without changing the control means of microcontroller or CPLD ("Complex Programmable Logic Device") type and their programming of software or VHDL ("VHSIC Hardware Description Language") configuration type. There is a very great benefit in keeping these parts strictly unchanged like the programs, the test sequences, the protocols for dialogue with upstream of the viewing system.

What is claimed is:

1. A control device for controlling luminance of a lighting device comprising light-emitting diodes (LEDs), the control device comprising:

an analog electronic circuit that includes at least one of an integrator circuit or an amplitude generating circuit, wherein the control device controls the luminance of the LEDs with a single digital signal and without performing luminance calculations using digital components, wherein the control device is driven by a cyclic input signal of a determined period, the cyclic input signal being the single digital signal, wherein the determined period includes an activation time representative of a determined luminance level, wherein the cyclic input signal controls a turning on of the LEDs during the activation time, wherein the analog electronic circuit generates an analog control signal based on the cyclic input signal being an input of the analog electronic circuit, wherein the analog control signal controls, based on an amplitude of the analog control signal, an intensity of an electric current passing through the light-emitting diodes, and wherein the amplitude of the analog control signal is an increasing function of the activation time in such a way that a combination of the cyclic input signal and the analog control signal that is applied to the light-emitting diodes gives a greater luminance range than a range of the cyclic input signal.

2. The control device of claim 1, wherein when the analog electronic circuit includes the integrator circuit, the analog control signal corresponds to an output signal of the integrator circuit, the amplitude of the analog control signal being determined based on a time constant of the integrator circuit, and the time constant of the integrator circuit being greater than a predetermined minimum activation time.

3. The control device of claim 1, wherein, when the analog electronic circuit includes the amplitude ramp generating circuit, the amplitude of the analog control signal is sawtooth-shaped, a period of the sawtooth being that of the cyclic input signal.

4. A viewing device comprising:

a display screen with light modulation, a lighting device comprising light-emitting diodes (LEDs), and a control device comprising an analog electronic circuit that includes at least one of an integrator circuit or an amplitude generating circuit, wherein the control device controls the luminance of the LEDs with a single digital signal and without performing luminance calculations using digital components, wherein the control device is driven by a cyclic input signal of a determined period, the cyclic input signal being the single digital signal, wherein the determined period includes an activation time representative of a determined luminance level, wherein the cyclic input signal controls a turning on of the LEDs during the activation time, wherein the analog electronic circuit generates an analog control signal based on the cyclic input signal being an input of the analog electronic circuit, wherein the analog control signal controls, based on an amplitude of the analog control signal, an intensity of an electric current passing through the light-emitting diodes, and wherein the amplitude of the analog control signal is an increasing function of the activation time in such a way that a combination of the cyclic input signal and the analog control signal that is applied to the light-emitting diodes gives a greater luminance range than a range of the cyclic input signal.

5. The viewing device of claim 4, wherein, when the analog electronic circuit includes the integrator circuit, the analog control signal corresponds to an output signal of the integrator circuit, the amplitude of the analog control signal being determined based on a time constant of the integrator circuit, and the time constant of the integrator circuit being greater than a predetermined minimum activation time.

6. The viewing device of claim 4, wherein, when the analog electronic circuit includes the amplitude ramp generating circuit, the amplitude of the analog control signal is sawtooth-shaped, a period of the sawtooth being that of the cyclic input signal.

* * * * *